United States Patent [19]

McClary

[11] 4,414,169

[45] Nov. 8, 1983

[54] PRODUCTION OF POLYESTER FILAMENTS OF HIGH STRENGTH POSSESSING AN UNUSUALLY STABLE INTERNAL STRUCTURE EMPLOYING IMPROVED PROCESSING CONDITIONS

[75] Inventor: Edward B. McClary, Charlotte, N.C.

[73] Assignee: Fiber Industries, Inc., Charlotte, N.C.

[21] Appl. No.: 15,512

[22] Filed: Feb. 26, 1979

[51] Int. Cl.[3] ..... D01D 5/12

[52] U.S. Cl. ..... 264/210.7; 264/210.8

[58] Field of Search ..... 264/210.2, 210.3, 210.7, 264/210.8, 289.3, 289.6, 290.5, 290.7; 528/309

[56] References Cited

U.S. PATENT DOCUMENTS

| | | | |
|---|---|---|---|
| 3,259,681 | 7/1966 | Bull et al. | 264/210.3 |
| 3,527,862 | 9/1970 | Shimosako et al. | 264/210.7 |
| 3,816,486 | 6/1974 | Vail | 264/290.5 |
| 3,832,435 | 8/1974 | Bauer et al. | 264/210.8 |
| 3,840,633 | 10/1974 | Barbe et al. | 264/210.7 |
| 3,894,135 | 7/1975 | Riggert et al. | 264/210.7 |
| 3,946,094 | 3/1974 | Kanetsuna et al. | 264/210.7 |
| 3,975,488 | 8/1976 | Patterson | 264/290.7 |
| 4,101,525 | 7/1978 | Davis et al. | 528/309 |

*Primary Examiner*—Jay H. Woo

*Attorney, Agent, or Firm*—S. M. Bodenheimer, Jr.

[57] ABSTRACT

An improved process is provided for the formation of a high performance polyester multifilament yarn possessing a high strength and an unusually stable internal structure rendering it particularly suited for use in industrial applications at elevated temperatures. The filaments are melt spun and uniformly quenched under relatively high stress conditions to yield an as-spun filamentary material of relatively high birefringence which is passed in-line from the quench zone to a first draw zone provided at a temperature below the glass transition temperature of the as-spun filamentary material, for example at ambient temperature, where it is drawn. Subsequent drawing follows to achieve at least 85 percent of the maximum draw ratio of the as-spun filamentary material.

21 Claims, 4 Drawing Figures

PRODUCTION OF POLYESTER FILAMENTS OF HIGH STRENGTH POSSESSING AN UNUSUALLY STABLE INTERNAL STRUCTURE EMPLOYING IMPROVED PROCESSING CONDITIONS

CROSS-REFERENCE TO RELATED APPLICATIONS

The present invention represents an improvement over the process of commonly assigned U.S. Ser. No. 735,849, filed Oct. 26, 1976, now U.S. Pat. No. 4,195,052 in the names of Herbert L. Davis, Michael L. Jaffe, Herman L. LaNieve III, and Edward J. Powers.

The present process is capable of forming the product of commonly assigned U.S. Ser. No. 735,850, filed Oct. 26, 1976 (now U.S. Pat. No. 4,101,525, granted July 18, 1978), in the names of Herbert L. Davis, Michael L. Jaffe, Herman L. LaNieve III, and Edward J. Powers.

BACKGROUND OF THE INVENTION

Polyethylene terephthalate filaments of high strength are well known in the art and commonly are utilized in industrial applications. These may be differentiated from the usual textile polyester fibers by the higher levels of their tenacity and modulus characteristics, and often by a higher denier per filament. For instance, industrial polyester fibers commonly possess a tenacity of at least 7.5 (e.g. 8+) grams per denier and a denier per filament of about 3 to 15, while textile polyester fibers commonly possess a tenacity of about 3.5 to 4.5 grams per denier and a denier per filament of about 1 to 2. Commonly industrial polyester fibers are utilized in the formation of tire cord, conveyor belts, seat belts, V-belts, hosing, sewing thread, carpets, etc.

When polyethylene terephthalate is utilized as the starting material, a polymer having an intrinsic viscosity (I.V.) of about 0.6 to 0.7 deciliters per gram commonly is selected when forming textile fibers and a polymer having an intrinsic viscosity of about 0.7 to 1.0 deciliters per gram commonly is selected when forming industrial fibers. Both high stress and low stress sprinning processes heretofore have been utilized during the formation of polyester fibers. Representative spinning processes proposed in the prior art which utilize higher than usual stress on the spin line include those of U.S. Pat. Nos. 2,604,667; 2,604,689; 3,946,100; and British Pat. No. 1,375,151. However, polyester fibers heretofore more commonly have been formed through the utilization of relatively low stress spinning conditions to yield a filamentary material of relatively low birefringence (i.e. below about $+2\times10^{-3}$) which particularly is amenable to extensive hot drawing whereby the required tenacity values ultimately are developed. Such as-spun polyester fibers commonly are subjected to subsequent hot drawing which may or may not be carried out in-line when forming textile as well as industrial fibers in order to develop the required tensile properties.

Heretofore high strength polyethylene terephthalate fibers (e.g. of at least 7.5 grams per denier) commonly undergo substantial shrinkage (e.g. at least 8 percent) when heated. Also heretofore, when such polyester industrial fibers are incorporated in a rubber matrix of a tire, it has been recognized that as the tire rotates during use the fibers are sequentially stretched and relaxed to a minute degree during each tire revolution. More specifically, the internal air pressure stresses the fibrous reinforcement of the tire, and tire rotation while axially loaded causes repeated stress variations. Since more energy is consumed during the stretching of the fibers than is recovered during the relaxation of the same, the difference in energy is dissipated as heat and can be termed hysteresis or work loss. Therefore, significant temperature increases have been observed in rotating tires during use which are attributable at least in part to this fiber hysteresis effect. Lower rates of heat generation in tires will lower tire operating temperatures, maintain higher modulus values in the reinforcing fiber, and extend the life of the same through the minimization of degradation in the reinforcing fiber and in the rubber matrix. The effect of lower hysteresis rubbers has been recognized. See, for instance *Rubber Chem. Technol.*, 45, 1, by P. Kainradl and G. Kaufmann (1972). However, little has been published on hysteresis differences in reinforcing fibers and particularly hysteresis differences between various polyester fibers. See, for instance, U.S. Pat. No. 3,553,307 to F. J. Kovac and G. W. Rye.

In commonly assigned U.S. Ser. Nos. 735,849, and 735,850 (now U.S. Pat. No. 4,101,525), filed Oct. 26, 1976, are disclosed a process for forming polyester filaments of high strength having an unusually stable internal structure which particularly are suited for use in industrial applications at elevated temperatures, and the resulting product.

It is an object of the present invention to provide an improved process for the production of high performance polyester fibers of high strength which incorporates an initial draw step capable of facilitating a savings of energy when compared with typical polyethylene terephthalate drawing procedures of the prior art.

It is an object of the present invention to provide an improvement in the process of U.S. Ser. No. 735,849, filed Oct. 26, 1976, which has been found to impart additional stability and reliability to the overall process.

It is a further object of the present invention to provide an improved process for the production of high performance polyester fibers of high strength which incorporates a first draw step which is carried out in a first draw zone provided at a temperature below the glass transition temperature of the as-spun filamentary material in the surprising absence of substantial neck drawing.

These and other objects will be apparent to those skilled in the art from the following description and appended claims.

SUMMARY OF THE INVENTION

It has been found that in a process for the production of polyester filaments of high stength having an unusually stable internal structure which particularly are suited for use at elevated temperatures and exhibit a work loss of 0.004 to 0.02 inch-pounds when cycled between a stress of 0.6 gram per denier and 0.05 gram per denier at 150° C. measured at a constant strain rate of 0.5 inch per minute on a 10 inch length of yarn of the filaments normalized to that of a multifilament yarn of 1000 total denier comprising:

(a) extruding a molten melt-spinnable polyester which contains 85 to 100 mol percent polyethylene terephthalate and 0 to 15 mol percent of copolymerized ester units other than polyethylene terephthalate having an intrinsic viscosity of 0.5 to 2.0 deciliters per gram through a shaped extrusion orifice having a plurality of openings to form a molten filamentary material, (b) passing the resulting molten filamentary material in the direction of its length through a solidification zone having an entrance end and an exit end wherein the molten filamentary material is uniformly quenched and transformed into a solid filamentary material, (c) withdrawing the solid filamentary material from the solidification zone while under a substantial stress of 0.015 to 0.150 gram per denier measured immediately below the exit end of the solidification zone, (d) continuously conveying the resulting as-spun filamentary material from the exit end of the solidification zone to a stress isolation device at a rate of approximately 500 to 3000 meters per minute with the filamentary material as it enters the stress isolation device exhibiting a relatively high birefringence of $+9\times10^{-3}$ to $+70\times10^{-3}$, (e) continuously conveying the resulting filamentary material from the stress isolation device to a first draw zone, (f) continuously drawing the resulting filamentary material at a draw ratio of 1.01:1 to 3.0:1 while present in the first draw zone, and (g) subsequently thermally treating the previously drawn filamentary material while under a longitudinal tension and present at a temperature above that of the first draw zone to achieve at least 85 percent of the maximum draw ratio of the as-spun filamentary material and impart a tenacity of at least 7.5 grams per denier to the same, with at least the final portion of the thermal treatment being conducted at a temperature within the range from about 90° C. below the differential scanning calorimeter peak melting temperature of the same up to below the temperature at which filament coalescence occurs;

that improved results are achieved by providing the first draw zone in which step (f) is carried out at a temperature below the glass transition temperature of the as-spun filamentary material thereby facilitating a savings of energy when compared with typical polyethylene terephthalate drawing procedures of the prior art, and concomitantly enabling the drawing step (f) to be carried out in combination with the other process steps on a stable basis in the substantial absence of filament neck drawing.

It has been found that an improved process for the production of polyester filaments of high strength having an unusually stable internal structure which particularly are suited for use at elevated temperatures, and exhibit a work loss of 0.004 to 0.02 inch-pounds when cycled between a stress of 0.6 gram per denier and 0.05 gram per denier at 150° C. measured at a constant strain rate of 0.5 inch per minute on a 10 inch length of yarn of the filaments normalized to that of a multifilament yarn of 1000 total denier, comprises:

(a) extruding a molten melt-spinnable polyester which contains 90 to 100 mol percent polyethylene terephthalate and 0 to 10 mol percent of copolymerized ester units other than polyethylene terephthalate having an intrinsic viscosity of 0.8 to 1.0 deciliters per gram (e.g. 0.85 to 0.94 deciliters per gram) through a shaped extrusion oriface having a plurality of openings to form a molten filamentary material, (b) passing the resulting molten filamentary material in the direction of its length through a solidification zone having an entrance end and an exit end provided with a gaseous atmosphere at a temperature below 80° C. (e.g. 10° to 50° C.) wherein the molten filamentary material is uniformly quenched and transformed into a solid filamentary material, (c) withdrawing the solid filamentary material from the solidification zone while under a substantial stress of 0.015 to 0.150 gram per denier (e.g. 0.015 to 0.1 gram per denier) measured immediately below the exit end of the solidification zone, (d) continuously conveying the resulting as-spun filamentary material from the exit end of the solidification zone to a stress isolation device at a rate of approximately 500 to 3000 meters per minute (e.g. 750 to 1250 meters per minute) with the filamentary material as it enters the stress isolation device exhibiting a relatively high birefringence of approximately $+20\times10^{-3}$ to $+35\times10^{-3}$ (e.g. $+25\times10^{-3}$ to $+35\times10^{-3}$), (e) continuously conveying the resulting filamentary material from the stress isolation device to a first draw zone which is provided at a temperature below the glass transition temperature of the as-spun filamentary material (e.g. 5° to 60° C. or 25° C.) thereby facilitating a savings of energy when compared with typical polyethylene terephthalate drawing procedures of the prior art, (f) continuously drawing the resulting filamentary material at a draw ratio of approximately 1.4:1 to 2.0:1 (e.g. 1.7:1 to 1.9:1) while present in the first draw zone on a stable basis in the substantial absence of filament neck drawing, and (g) subsequently thermally treating the previously drawn filamentary material while under a longitudinal tension and present at a temperature above that of the first draw zone to achieve at least 85 percent of the maximum draw ratio of the as-spun filamentary material and impart a tenacity of at least 7.5 grams per denier to the same, with at least the final portion of the thermal treatment being conducted at a temperature within the range from about 90° C. below the differential scanning calorimeter peak melting temperature of the same up to below the temperature at which filament coalescence occurs.

DESCRIPTION OF PREFERRED EMBODIMENTS

Figure 1:
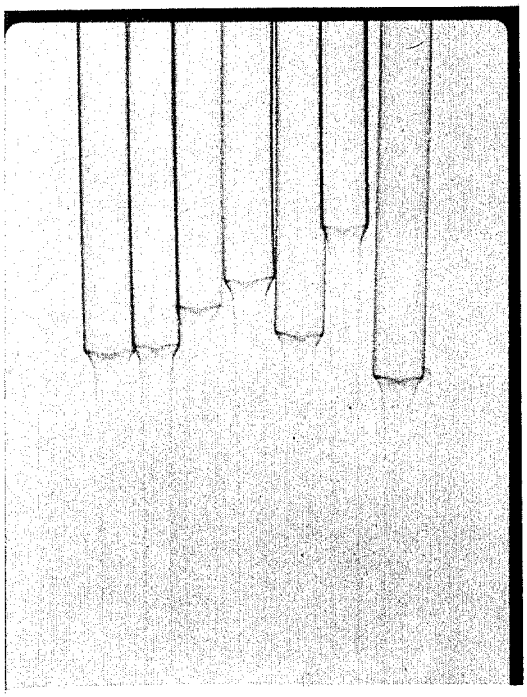
FIG. 1 is a photograph made at a magnification of 150X of conventionally spun and cold drawn polyethylene terephthalate filaments. The filaments were initially spun under relatively low stress conditions of about 0.002 gram per denier to form an as-spun yarn having a birefringence of $+1$ to $+2\times10^{-3}$ which was subsequently drawn at a slow rate at ambient temperature (i.e. approximately 25° C.). Substantial undesirable neck drawing is illustrated. Such fibers would be expected to have broken had the drawing been conducted at a commercial draw ratio and rate. Similarly appearing fibers would have been formed prior to breakage had such a commercial draw ratio and rate been utilized.

The melt-spinnable polyester for use in the present process is principally polyethylene terephthalate, and contains at least 85 mol percent polyethylene terephthalate, and preferably at least 90 mol percent polyethylene terephthalate. In a particularly preferred embodiment of the process the melt-spinnable polyester is substantially all polyethylene terephthalate. Alternatively, during the preparation of the polyester minor amounts of one or more ester-forming ingredient other than ethylene glycol and terephthalic acid or its derivatives may be copolymerized. For instance, the melt-spinnable polyester may contain 85 to 100 mol percent (preferably 90 to 100 mol percent) polyethylene terephthalate structural units and 0 to 15 mol percent (preferably 0 to 10 mol percent) copolymerized ester units other than polyethylene terephthalate. Illustrative examples of other ester-forming ingredients which may be copolymerized with the polyethylene terephthalate units include glycols such as diethylene glycol, trimethylene glycol, tetramethylene glycol, hexamethylene glycol, etc., and dicarboxylic acids such as isophthalic acid, hexahydroterephthalic acid, bibenzoic acid, adipic acid, sebacic acid, azelaic acid, etc. A minor amount of phenylglycidyl ether optionally may be present in physical admixture with the melt-spinnable polyester.

The melt-spinnable polyester for use in the present process prior to extrusion is selected to have an intrinsic viscosity (I.V.) of about 0.5 to 2.0 deciliters per gram, and preferably a relatively high intrinsic viscosity of 0.8 to 1.0 deciliters per gram, and most preferably 0.85 to 0.94 deciliters per gram. The I.V. of the melt-spinnable polyester may be conveniently determined by the equation $$\lim_{c \to o} \frac{\ln \eta r}{c},$$

where $\eta r$ is the "relative viscosity" obtained by dividing the viscosity of a dilute solution of the polymer by the viscosity of the solvent employed (e.g. orthochlorophenol) measured at the same temperature, and c is the polymer concentration in the solution expressed in grams/100 ml. The starting polymer additionally commonly exhibits a degree of polymerization (D.P.) of about 140 to 420, and preferably of about 140 to 180. The polyethylene terephthalate starting material commonly exhibits a glass transition temperature of about 75° to 80° C. and a melting point of about 250° to 265° C., e.g., about 260° C.

The shaped extrusion orifice (i.e. the spinneret) has a plurality of openings and may be selected from among those commonly utilized during the melt extrusion of filamentary materials. The number of openings in the spinneret can be varied widely. A standard conical spinneret containing 6 to 750 holes (preferably 180 to 730 holes) such as commonly used in the melt spinning of polyethylene terephthalate, having a diameter of about 5 to 50 mils (e.g., 10 to 30 mils) may be utilized in the process. Yarns of about 180 to 730 continuous filaments are commonly formed. The melt-spinnable polyester is supplied to the extrusion orifice at a temperature above its melting point and below the temperature at which the polymer degrades substantially.

A molten polyester consisting principally of polyethylene terephthalate is preferably at a temperature of about 270° to 325° C., and most preferably at a temperature of about 280° to 320° C. when extruded through the spinneret.

Following extrusion through the shaped orifice the resulting molten polyester filamentary material is passed in the direction of its length through a solidification zone having an entrance end and an exit end wherein the molten filamentary material uniformly is quenched and is transformed to a solid fragmentary material. No shroud is provided intermediate the spinneret and the solidification zone. Commonly the entrance end of the solidification zone is approximately 1 to 3 inches below the spinneret face. The quench employed is uniform in the sense that differential or asymmetric cooling is not contemplated. The exact nature of the solidification zone is not critical to the operation of the process provided a substantially uniform quench is accomplished. In a preferred embodiment of the process the solidification zone is a gaseous atmosphere provided at the requisite temperature. Such gaseous atmosphere of the solidification zone may be provided at a temperature below about 80° C. Within the solidification zone the molten material passes from the melt to a semi-solid consistency, and from the semi-solid consistency to a solid consistency. While present in the solidification zone the material undergoes substantial orientation while present as a semi-solid as discussed hereafter. The gaseous atmosphere present within the solidification zone preferably circulates so as to bring about more efficient heat transfer. In a preferred embodiment of the process the gaseous atmosphere of the solidification zone is provided at a temperature of about 10° to 60° C. (e.g. 10° to 50° C.) and most preferably at about 10° to 40° C. (e.g. at room temperature or about 25° C.). The chemical composition of the gaseous atmosphere is not critical to the operation of the process provided the gaseous atmosphere is not unduly reactive with the polymeric filamentary material. In a particularly preferred embodiment of the process the gaseous atmosphere of the solidification zone is air. Other representative gaseous atmospheres which may be selected for utilization in the solidification zone include inert gases such as nitrogen, helium, argon, etc.

As previously indicated, the gaseous atmosphere of the solidification zone impinges upon the extruded polyester material so as to produce a uniform quench wherein no substantial radial non-homogeneity or disproportional orientation exists across the product. The uniformity of the quench may be demonstrated through an examination of the filamentary product of the present process by its ability to exhibit no substantial tendency to undergo self-crimping upon the application of heat. For instance, a yarn product which has undergone a non-uniform quench in the sense the term is utilized in the present application will be self-crimping and undergo a spontaneous crimping when heated above its glass transition temperature while in a free-to-shrink condition.

The extruded polymeric material commonly is present while suspended in the solidification zone for a residence time of about 0.009 to 0.15 second, and most preferably for a residence time of about 0.009 to 0.055 second. Commonly the solidification zone possesses a length of about 0.5 to 8 feet, and preferably a length of 0.5 to 3 feet. A center flow quench is preferred; however, any other technique capable of bringing about the desired quenching alternatively may be utilized.

The solid filamentary material next is withdrawn from the solidification zone while under a substantial stress of 0.015 to 0.150 gram per denier, and preferably under a substantial stress of 0.08 to 0.12 gram per denier (e.g. 0.1 gram per denier). The stress is measured at a point immediately below the exit end of the solidification zone and prior to lubricant application (if any). For instance, the stress may be measured by placing a tensionmeter on the filamentary material as it exits from the solidification zone. As will be apparent to those skilled in the art, the exact stress upon the filamentary material is influenced by the molecular weight of the polyester, the temperature of the molten polyester when extruded, the size of the spinneret openings, the polymer throughput rate during melt extrusion, the quench temperature, and the rate at which the as-spun filamentary material is withdrawn from the solidification zone. Commonly, the as-spun filamentary material is withdrawn from the solidification zone while under the substantial stress indicated at a rate of about 500 to 3000 meters per minute (e.g. at a rate of 750 to 1250 meters per minute).

In the relatively high stress melt spinning process of the present invention the extruded filamentary material intermediate the point of its maximum die swell area and its point of withdrawal from the solidification zone commonly exhibits a substantial drawdown. For instance, the as-spun filamentary material may exhibit a drawdown ratio of about 100:1 to 3000:1, and most commonly a drawdown ratio of about 500:1 to 2000:1. The "drawdown ratio" as used above is defined as the ratio of the maximum die swell cross-sectional area to the cross-sectional area of the filamentary material as it leaves the solidification zone. Such substantial change in cross-sectional area occurs almost exclusively in the solidification zone prior to complete quenching.

The as-spun filamentary material as it leaves the solidification zone commonly exhibits a denier per filament of about 2 to 80, and preferably 3 to 8 (e.g. about 5).

The as-spun filamentary material is conveyed in the direction of its length from the exit end of the solidification zone to a stress isolation device. There is no stress isolation along the length of the filamentary material intermediate the shaped extrusion orifice (i.e. spinneret) and the exit end of the solidification zone. The stress isolation device can take a variety of forms as will be apparent in the art. For instance, the stress isolation device can conveniently take the form of a pair of skewed rolls. The as-spun filamentary material may be wound in a plurality of turns about the skewed rolls which serve to isolate the stress upon the same as the filamentary material approaches the rolls from the stress upon the filamentary material as it leaves the rolls. Other representative devices which may serve the same function include: air jets, snubbing pins, ceramic rods, etc.

The relatively high spin-line stress upon the filamentary material yields a filamentary material of relatively high birefringence. For instance, the filamentary material as it enters the stress isolation device exhibits a birefringence of $+9\times10^{-3}$ to $+70\times10^{-3}$, and preferably $+20\times10^{-3}$ to $+35\times10^{-3}$, and most preferably $+25\times10^{-3}$ to $+30\times10^{-3}$. In order to determine the birefringence of the filamentary material at this point in the process, a representative sample may be simply collected at the stress isolation device and analyzed in accordance with conventional procedures at an off-line location. For instance, the birefringence of the filaments can be determined by using a Berek compensator mounted in a polarizing light microscope, which expresses the difference in the refractive index parallel and perpendicular to the fiber axis. The birefringence level achieved is directly proportional to stress exerted on the filamentary material as previously discussed. Prior art processes for the production of as-spun polyester filamentary materials ultimately intended for either textile or industrial applications have commonly been carried out under relatively low stress spinning conditions and have yielded as-spun filamentary materials of a considerably lower birefringence (e.g. a birefringence of about $+1\times10^{-3}$ to $+2\times10^{-3}$).

Figure 3:
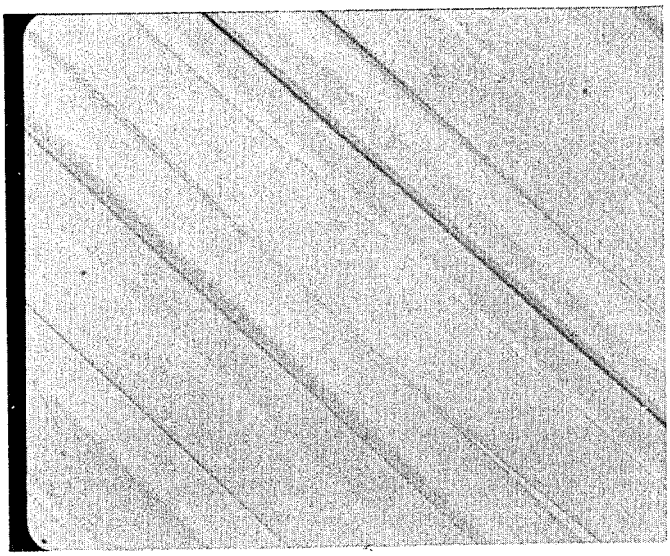
FIG. 3 is a photograph made at a magnification of 630X of polyethylene terephthalate filaments which were formed in accordance with the process of the present invention employing a commercial draw ratio and rate. No substantial evidence of neck drawing is apparent.
Figure 4:
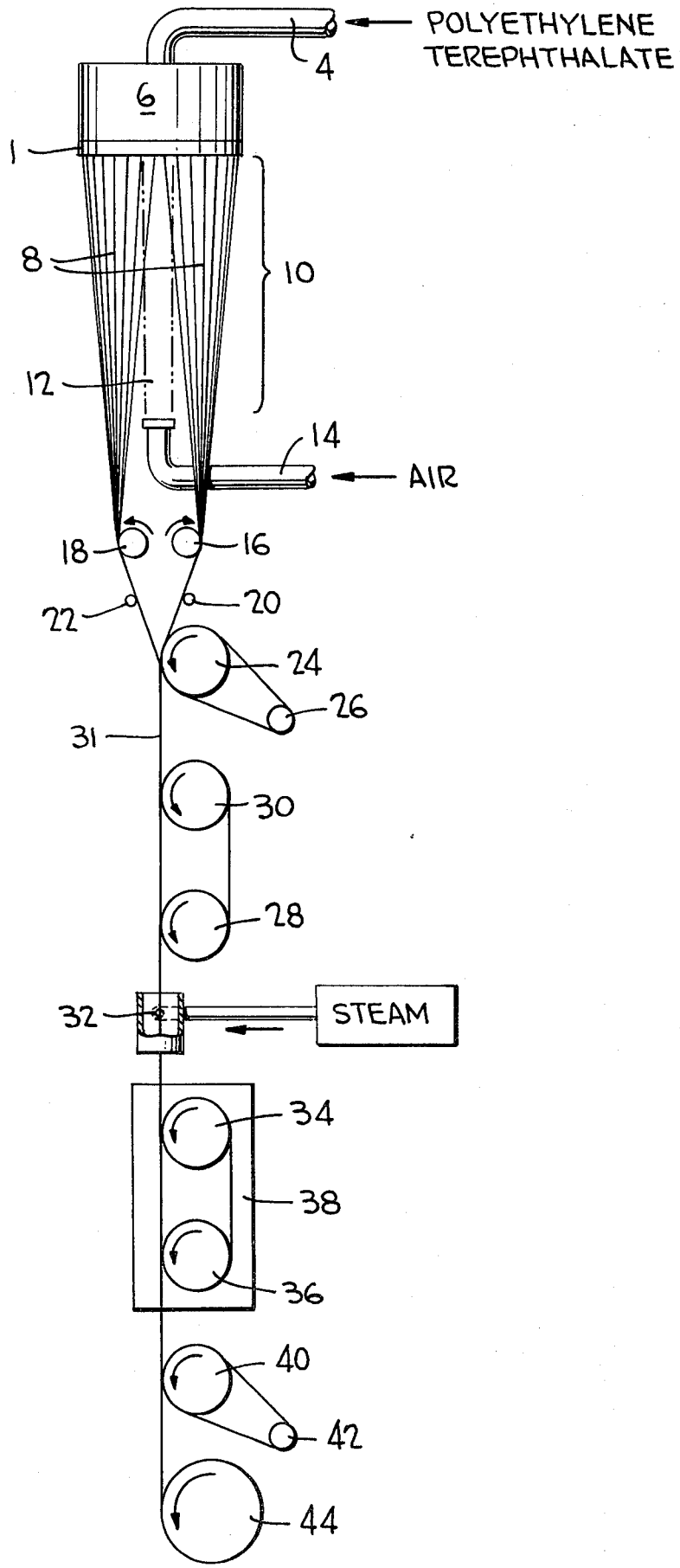
FIG. 4 illustrates schematically a representative apparatus arrangement for carrying out the improved polyethylene terephthalate fiber-forming process of the present invention. The first drawing zone between rolls 24 and 30 is provided at ambient temperature (i.e. approximately 25° C.) and the filamentary material is drawn therein in the substantial absence of neck drawing.

The as-spun filamentary material continuously is conveyed in the direction of its length from the stress isolation device to a first draw zone provided at a temperature below the glass transition temperature of the as-spun filamentary material. Preferably the first draw zone is provided at room temperature (i.e. approximately 25° C.) with no external heat being applied to the filamentary material. It has been found that the as-spun filamentary material may be drawn on a more highly reliable and stable basis in such draw zone when compared with conventional polyethylene terephthalate draw zones which commonly are provided at a more highly elevated temperature above the glass transition temperature of the filamentary material. An energy savings results, and it surprisingly has been found that this drawing step can be carried out in combination with the other process steps in the substantial absence of neck drawing. See FIG. 1 for an indication of the substantial neck drawing encountered with conventionally spun and cold drawn polyethylene terephthalate filaments which were initially spun under relatively low stress conditions. FIG. 3 is indicative of the results achieved in accordance with the present process. Generally no neck drawing is apparent from a visual examination of the filaments drawn in accordance with the present process. While present in the first draw zone the as-spun filamentary material preferably is drawn at least 50 percent of its maximum draw ratio (e.g. about 50 to 80 percent of the maximum draw ratio). The "maximum draw ratio" of the as-spun filamentary material is defined as the maximum draw ratio to which the as-spun filamentary material may be drawn on a practical and reproducible basis without encountering breakage thereof.

The draw ratio utilized in the first draw zone ranges from 1.01:1 to 3.0:1, and preferably from 1.4:1 to 2.0:1, and most preferably from 1.7:1 to 1.9:1. Such draw ratios are based upon roll surface speeds immediately before and after the draw zone. The lower draw ratios within this range are commonly but not necessarily employed in conjunction with as-spun filaments of the higher birefringence levels specified, and the higher draw ratios with the lower birefringence levels specified. The apparatus utilized to carry out the requisite degree of drawing in the first draw zone can be varied. For instance, the first draw step can be conveniently carried out by passing the filamentary material in the direction of its length between two pairs of unheated draw rolls with the second pair rotating at a higher rate than the first pair. Additionally, the first draw step (as described) can be carried out in a plurality of stages so long as the yarn is not heated above its glass transition temperature. At the completion of the first draw step of the present process the filamentary material commonly exhibits a tenacity of about 3 to 5 grams per denier measured at 25° C.

The filamentary material following the first draw step (as described) is thermally treated while under a longitudinal tension at a temperature above that of the first draw zone and above the glass transition temperature of the filamentary material. The thermal treatment preferably is carried out in an in-line continuous manner immediately following passage from the first draw zone, or the filamentary material may be collected after passage through the first draw zone and finally subjected to the thermal treatment at a later time. The thermal treatment optionally can be carried out in a plurality of stages, for example at successively elevated temperatures. In an embodiment of the present process a final portion of the heat treatment conveniently can be carried out during the tire cord formation procedure in which several yarns are twisted, an adhesive is applied, and the filaments are heated while under longitudinal tension. It will be apparent to those skilled in the art that in order to accurately characterize the resulting yarn filaments it will be essential that such thermal treatment be repeated with a flat yarn in the absence of an adhesive prior to analysis. Variables such as yarn twist and the presence of a coating of an adhesive obviously would interfer with the determination of fundamental characteristics discussed hereafter. The nature of the heat transfer media utilized during the thermal treatment may be varied widely. For instance, the heat transfer medium may be a heated gas, or a heated contact surface, such as one or more hot shoes or hot rollers. The longitudinal tension utilized preferably is sufficient at least to prevent shrinkage during each stage; however, a final slight relaxation step may be utilized (as described hereafter). During the thermal treatment the filamentary material is drawn to achieve at least 85 percent of the maximum draw ratio (previously discussed), and preferably at least 90 percent of the maximum draw ratio. Crystallization and heat setting are imparted to the filamentary material during this subsequent thermal trreatment.

The drawing followed by the thermal treatment imparts a tenacity of at least 7.5 grams per denier to the filamentary material measured at 25° C., and preferably a tenacity of at least 8 grams per denier. The tensile properties referred to herein may be determined through the utilization of an Instron tensile tester (Model TM) using a 3⅓ inch gauge length and a strain rate of 60 percent per minute in accordance with ASTM D2256. The fibers prior to testing are conditioned for 48 hours at 70° F. and 65 percent relative humidity in accordance with ASTM D1776.

It is essential that the final portion of the thermal treatment be carried out at a temperature within the range from about 90° C. below the differential scanning calorimeter peak melting temperature of the filamentary material up to below the temperature at which coalescence of adjoining filaments occurs. In a preferred embodiment of the process the final portion of the thermal treatment is carried out at a temperature within the range from 60° C. below the differential scanning calorimeter peak melting temperature up to below the temperature at which coalescence of adjoining filaments occurs. For a polyester filamentary material which is substantially all polyethylene terephthalate the differential scanning calorimeter peak melting temperature of the filamentary material is commonly observed to be about 260° C. The final portion of the thermal treatment commonly is carried out at a temperature of about 190 to 240° C. in the absence of filament coalescence.

If desired, an optional shrinkage or relaxation step may be carried out wherein the filamentary material previously described is allowed to shrink slightly, and thereby slightly to alter the properties thereof. For instance, the resulting filamentary material may be allowed to shrink up to about 14 percent (preferably 2 to 10 percent) by heating while positioned between moving rolls having a ratio of surface speeds such to allow the desired shrinkage. Such optional shrinkage step tends further to reduce the residual shrinkage characteristics and to increase the elongation of the final product.

The multifilament yarn which is produced by the process of the present invention commonly possesses a denier per filament of about 1 to 20 (e.g. about 2 to 5), and commonly consists of about 6 to 750 continuous filaments (e.g. about 180 to 730 continuous filaments). The denier per filament and the number of continuous filaments present in the yarn may be varied widely by adjusting process parameters as will be apparent to those skilled in the art.

The filamentary product particularly is suited for use in industrial applications wherein high strength polyester fibers have been utilized in the prior art. The internal structure (discussed hereafter) of the filamentary material has been found to be unusually stable and renders the fibers particularly suited for use in environments where elevated temperatures (e.g. 80° to 180° C.) are encountered. Not only does the filamentary material undergo a relatively low degree of shrinkage for a high strength product, but exhibits an unusually low degree of hysteresis or work loss during use in environments wherein it is repeatedly stretched and relaxed.

The multifilament yarn product is non-self-crimping and exhibits no substantial tendency to undergo self-crimping upon the application of heat. The yarn may be conveniently tested for a self-crimping propensity by heating by means of a hot air oven to a temperature above its glass transition temperature, e.g. to 100° C. while in a free-to-shrink condition. A self-crimping yarn will spontaneously assume a random non-linear configuration, while a non-self-crimping yarn will tend to retain its original linear configuration while possibly undergoing some shrinkage.

The unusually stable internal structure of the filamentary material commonly is evidenced by the following combination of characteristics:

(a) a birefringence value of +0.160 to +0.189, (b) a stability index value of 6 to 45 obtained by taking the reciprocal of the product resulting from multiplying the shrinkage at 175° C. in air measured in percent times the work loss at 150° C. between a stress cycle of 0.6 grams per denier and 0.05 gram per denier measured at a constant strain rate of 0.5 inch per minute in inch-pounds on a 10 inch length of yarn normalized to that of a multi-filament yarn of 1000 total denier, and (c) a tensile index value greater than 825 (e.g. 830 to 2500 or 830 to 1500) measured at 25° C. and obtained by multiplying the tenacity expressed in grams per denier times the initial modulus expressed in grams per denier.

Stated differently the unusually stable internal structure of the filamentary material commonly is evidenced by the following combination of characteristics:

(a) a crystallinity of 45 to 55 percent, (b) a crystalline orientation function of at least 0.97, (c) an amorphous orientation function of 0.37 to 0.60, (d) a shrinkage less than 8.5 percent in air at 175° C., and (e) an initial modulus of at least 110 grams per denier at 25° C. (e.g. 110 to 150 grams per denier), (f) a tenacity of at least 7.5 grams per denier at 25° C. (e.g. 7.5 to 10 grams per denier) and preferably at least 8 grams per denier at 25° C., and (g) a work loss of 0.004 to 0.02 inch-pounds between a stress cycle of 0.6 gram per denier and 0.05 gram per denier at 150° C. measured at a constant strain rate of 0.5 inch per minute on a 10 inch length of yarn normalized to that of a multifilament yarn of 1000 total denier.

As will be apparent to those skilled in the art, the birefringence of the product is measured on representative individual filaments of the multifilament yarn and is a function of the filament crystalline portion and the filament amorphous portion. See, for instance, the article by Robert J. Samuels in *J. Polymer Science*, A2, 10, 781 (1972). The birefringence may be expressed by the equation:

$$\Delta n \times X f_c \Delta n_c + (1-X) f_a \Delta n_a + \Delta n_f \quad (1)$$

where $\Delta n$ = birefringence

X = fraction crystalline $f_c$ = crystalline orientation function $\Delta n_c$ = intrinsic birefringence of crystal (0.220 for polyethylene terephthalate)

$f_a$ = amorphous orientation function $\Delta n_a$ = intrinsic birefringence of amorphous (0.275 for polyethylene terephthalate)

$\Delta n_f$ = form birefringence (values small enough to be neglected in this system)

The birefringence of the product may be determined by using a Berek compensator mounted in a polarizing light microscope, and expresses the difference in the refractive index parallel and perpendicular to the fiber axis. The fraction crystalline, X, may be determined by conventional density measurements. The crystalline orientation function, $f_c$, may be calculated from the average orientation angle, $\theta$, as determined by wide angle x-ray diffraction. Photographs of the diffraction pattern may be analyzed for the average angular breadth of the (010) and (100) diffraction arcs to obtain the average orientation angle, $\theta$. The crystalline orientation function, $f_c$, may be calculated from the following equation:

$$f_c = \tfrac{1}{2}(3 \cos^2 \theta - 1) \quad (2)$$

Once $\Delta n$, X, and $f_c$ are known, $f_a$, may be calculated from equation (1). $\Delta n_c$ and $\Delta n_a$ are intrinsic properties of a given chemical structure and will change somewhat as the chemical constitution of the molecule is altered, i.e., by copolymerization, etc.

The birefringence value exhibited by the product of the present process of +0.160 to +0.189 (e.g. +0.160 to +0.185) tends to be lower than that exhibited by filaments from commercially available polyethylene terephthalate tire cords formed via a relatively low stress spinning process followed by substantial drawing outside the spinning column. For instance, filaments from commercially available polyethylene terephthalate tire cords commonly exhibit a birefringence value of about +0.190 to +0.205. Additionally, as reported in commonly assigned U.S. Pat. No. 3,946,100 the product of that process involving the use of a conditioning zone immediately below the quench zone in the absence of stress isolation exhibits a substantially lower birefringence value than that of the filaments formed by the present process. For instance, polyethylene terephthalate filaments formed by the process of U.S. Pat. No. 3,946,100 exhibit a birefringence value of about +0.100 to +0.140.

Since the crystallinity and crystalline orientation function ($f_c$) values for the product tend to be substantially the same as those of commercially available polyethylene terephthalate tire cords, it is apparent that the product of the process is a substantially fully drawn crystallized fibrous material. However, the amorphous orientation function ($f_a$) value for the product (i.e. 0.37 to 0.60) is lower than that exhibited by commercially available polyethylene terephthalate tire cord yarns having equivalent tensile properties (i.e. tenacity and initial modulus). For instance, amorphous orientation values of at least 0.64 (e.g. 0.8) are exhibited in commercially available tire cord yarns.

The product characterization parameters referred to herein other than birefringence, crystallinity, crystalline orientation function, and amorphous orientation function conveniently may be determined by testing the resulting multifilament yarns consisting of substantially parallel filaments. The entire multifilament yarn may be tested, or alternatively, a yarn consisting of a large number of filaments may be divided into a representative multifilament bundle of a lesser number of filaments which is tested to indicate the corresponding properties of the entire larger bundle. The number of filaments present in the multifilament yarn bundle undergoing testing conveniently may be about 20. The filaments present in the yarn during testing are untwisted.

The highly satisfactory tenacity values (i.e. at least 7.5 grams per denier), and initial modulus values (i.e. at least 10 grams per denier) of the product of the present process compare favorably with these particular parameters exhibited by commercially available polyethylene terephthalate tire cord yarns and may be determined in accordance with ASTM D2256 as previously indicated.

The high strength multifilament product of the present process possesses an internal morphology which manifests an unusually low shrinkage propensity of commonly less than 8.5 percent, and preferably less than 5 percent when measured in air at 175° C. For instance, filaments of commercially available polyethylene terephthalate tire cord yarns commonly shrink about 12 to 15 percent when tested in air at 175° C. These shrinkage values may be determined through the utilization of a DuPont Thermomechanical Analyzer (Model 941) operated under zero applied load and at a 10° C./min. heating rate with the gauge length held constant at 0.5 inch. Such improved dimensional stability is of particular importance if the product serves as fibrous reinforcement in a radial tire.

The unusually stable internal structure of the product of the present invention is further manifest in its low work loss or low hysteresis characteristics (i.e. low heat generating characteristics) in addition to its relatively low shrinkage propensity for a high strength fibrous material. The product of the present invention exhibits a work loss of 0.004 to 0.02 inch-pounds when cycled between a stress of 0.6 gram per denier and 0.05 gram per denier at 150° C. measured at a constant strain rate of 0.5 inch per minute on a 10 inch length of yarn normalized to that of a multifilament yarn of 1000 total denier as described hereafter. On the contrary such work loss characteristics of commercially available polyethylene terephthalate tire cord yarn (which was initially spun under relatively low stress conditions of about 0.002 gram per denier to form an as-spun yarn having a birefringence of $+1$ to $+2\times10^{-3}$, and subsequently was drawn to develop the desired tensile properties) is about 0.045 to 0.1 inch-pounds under the same conditions. The work loss characteristics referred to herein may be determined in accordance with the slow speed test procedure described in "A Technique for Evaluating the Hysteresis Properties of Tire Cords", by Edward J. Powers appearing in *Rubber Chem. and Technol.*, 47, No. 5, December, 1974, pages 1053–1065, and additionally is described in detail hereafter.

As bias ply tires rotate, the cords which serve as fibrous reinforcement are cyclically loaded (see R. G. Patterson, *Rubber Chem. Technol.*, 42 1969, page 812). Typically, more work is done in loading (stretching) a material than is recovered during unloading (relaxation). And, the work loss, or hysteresis, is dissipated as heat which raises the temperature of the cyclically deformed material. (T. Alfrey, "Mechanical Behavior of High Polymers", Interscience Publishers, Inc., New York, 1948, page 200; J. D. Ferry, "Viscoelastic Properties of Polymers", John Wiley and Sons, Inc., New York, 1970, page 607; E. H. Andrews in "Testing of Polymers", 4, W. E. Brown, Ed., Interscience Publishers, New York, 1969, pages 248–252.)

As described in the above-identified article by Edward J. Powers the work loss test which yields the identified work loss values is dynamically conducted and simulates a stress cycle encountered in a rubber vehicle tire during use wherein the polyester fibers serve as fibrous reinforcement. The method of cycling was selected on the basis of results published by Patterson (*Rubber Chem. Technol.*, 42, 1969, page 812) wherein peak loads were reported to be imposed on cords by tire air pressure and unloading was reported to occur in cords going through a tire foot print. For slow speed test comparisons of yarns, a peak stress of 0.6 gram per denier and a minimum stress of 0.05 gram per denier were selected as being within the realm of values encountered in tires. A test temperature of 150° C. was selected. This would be a severe operating tire temperature, but one that is representative of the high temperature work loss behavior of tire cords. Identical lengths of yarn (10 inches) were consistently tested and work loss data are normalized to that of a 1000 total denier yarn. Since denier is a measure of mass per unit length, the product of length and denier ascribes a specific mass of material which is a suitable normalizing factor for comparing data.

Generally stated the slow speed test procedure employed allows one to control the maximum and minimum loads and to measure work. A chart records load (i.e. force or stress on the yarn) versus time with the chart speed being synchronized with the cross head speed of the tensile tester utilized to carry out the test. Time can accordingly be converted to the displacement of the yarn undergoing testing. By measuring the area under the force-displacement curve of the tensile tester chart, the work done on the yarn to produce the deformation results. To obtain work loss, the area under the unloading (relaxation) curve is subtracted from the area under the loading (stretching) curve. If the unloading curve is rotated, 180° about a line drawn vertically from the intercept of the loading and unloading curves, a typical hysteresis loop results. Work loss is the force-displacement integral within the hysteresis loop. These loops would be generated directly if the tensile tester chart direction was reversed synchronously with the loading and unloading directions of the tensile tester cross head. However, this is not convenient, in practice, and the area within the hysteresis loop may be determined arithmetically.

As previously indicated, comparisons of the results of the slow speed work loss procedure indicate that chemically identical polyethylene terephthalate multifilament yarns which are formed by differing types of processing exhibit significantly different work loss behavior. Such differing test results can be attributed to significant variations in the internal morphology of the same. Since the work loss is converted to heat the test offers a measure of the heat producing characteristic that comparable yarns or cords will have during deformations similar to those encountered in a loaded rolling tire. If the morphology of a given cord or yarn is such that it produces less heat per cycle, i.e. in one tire revolution, then its rate of heat generation will be lower at higher frequencies of deformation, i.e. higher tire speeds, and its resultant temperature will be lower than that of a yarn or cord which produces more heat per cycle.

Figure 2:
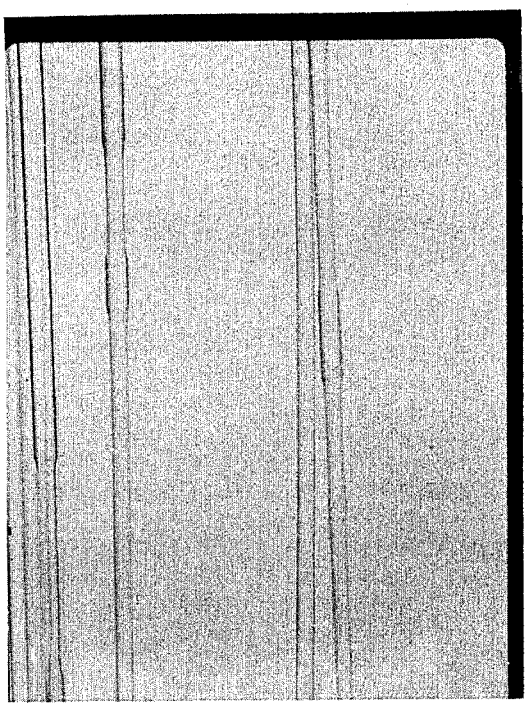
FIG. 2 is a photograph made at a magnification of 150X of polyethylene terephthalate filaments which were initially spun under the relatively high stress conditions as specificed by Applicant immediately after a first draw step at a slow rate conducted at ambient temperature (i.e. approximately 25° C.). No substantial neck drawing is apparent. Had such drawing been conducted at a commercial draw ratio and rate (for example 1.75:1 at 1727 meters per minute take-up), then filaments possessing no substantial evidence of neck drawing would be formed.

FIG. 2 of U.S. Pat. No. 4,101,525 is representative of the hysteresis curve for a conventional polyethylene terephthalate tire cord yarn wherein the filamentary material is initially spun under relatively low stress conditions of about 0.002 gram per denier to form an as-spun yarn having a birefringence of $+1$ to $+2\times10^{-3}$ and which is subsequently drawn to develop the desired tensile properties.

Set forth below is a detailed description of the slow speed test procedure for determining the work loss value for a given multifilament yarn employing an Instron Model TTD tensile tester with oven, load cell, and chart.

A. Heat oven to 150° C.

B. Determine denier of yarn to be tested.

C. Calibrate equipment.

Set full scale load (FSL) to impose 1 gram per denier stress on the yarn at full scale. Set cross head speed for 0.5 inch per minute.

D. Sample placement.

With the equipment at the test temperature the yarn is clamped in the upper jaw and held in 0.01 gram per denier stress (g/d) as the lower jaw is fastened. Care should be exercised to place the yarn quickly, avoiding excessive shrinkage of the sample. The gauge length of yarn to be tested should be 10 inches.

E. Run test.

1. Start chart.
2. Start crosshead-down.
3. At the load which produces 0.6 g/d stress reverse crosshead.
4. At the load which produces 0.5 g/d stress reverse crosshead.
5. Cycle four times between 0.6 and 0.5 gram per denier.
6. On the next crosshead-up, reverse the crosshead motion at 0.4 g/d.
7. Cycle between 0.6 g/d and 0.4 g/d for four cycles.
8. On the next crosshead-up, reverse crosshead motion at 0.3 g/d.
9. Continue in this fashion, cycling between 0.6 g/d and 0.3 g/d for four cycles, then between 0.6 g/d and 0.2 g/d for four cycles, then between 0.6 g/d and 0.1 g/d for four cycles, and finally between 0.6 g/d and 0.05 g/d for four cycles.

F. Data Collection

For work loss per cycle per 10 inch length of yarn normalized to that of a yarn of 1000 total denier the following formula may be used. Use only the data from the fourth cycle of the 0.6 g/d to 0.05 g/d load cycle when determining the work loss referred to herein.

$$W = Ac \times \frac{FSL \times CHS}{A_t} \times \frac{1000}{\text{yarn denier}}$$

W = work (inch-pounds/cycle/1000 denier-10 inch)

$A_c$ = area under curve (either loading or unloading)

FSL = full scale load (pounds)

CHS = crosshead speed (inches/minute)

$A_t$ = area generated by pen at full scale load for one minute

Work Loss = $W_I - W_O$ $W_I$ = work done to load sample $W_O$ = work recovered during relaxation The areas $A_c$ and $A_t$ can be determined by any number of methods as counting small squares or using a polar planimeter.

It is also possible to make a copy of the curve, cut out the curves and weigh the paper. However, care must be exercised in allowing the paper to reach a reproducible equilibrium moisture content. By this method the previous formula for determining work becomes:

$$W = \frac{Wt_c \times FSL \times CHS}{Wt_T} \times \frac{1000}{\text{yarn denier}}$$

W = work (inch-pounds/cycle/1000 denier-10 inch)

$Wt_c$ = weight of cut out curve (e.g. in grams)

FSL = as above

CHS = as above $Wt_T$ = weight of area of paper generated by the full scale load for one minute (e.g. in grams)

The above formula for work loss is the same.

It should be noted that the test can be automated and data collection facilitated by interfacing a digital integrator with the Instron tensile tester as described in the above-identified article by Edward J. Powers.

There is disagreement in the literature as to the relative percentages of total heat in a tire produced by the cords, rubber, road friction etc. See F. S. Conant, *Rubber Chem. Technol.*, 44, 1971, page 297; P. Kainradl and G. Kaufmann, *Rubber Chem., Technol.*, 45, 1972 page 1; N. M. Trivisonno, "Thermal Analysis of a Rolling Tire", SAE Paper 7004 4, 1970; P. R. Willett, *Rubber Chem. Technol.*, 46, 1973, page 425; J. M. Collins, W. L. Jackson and P. S. Oubridge, *Rubber Chem. Technol.*, 38, 1965, page 400. However, the cords are the load bearing element in tires and as their temperature increases several undesirable consequences follow. As temperatures increase, the heat generated per cycle by the cords generally increases. It is well known that rates of chemical degradation increase with increasing temperature. And, it is also well known that fiber moduli decrease as the cord temperature increases which permits greater strains in the tire to increase the heat generated in the rubber. All of these factors will tend to increase the temperature of cords still further and if the increases are great enough, tire failure can result. It is obvious that optimum cord performance, particularly in critical applications, will result from cords having a minimal heat generating characteristic (work loss per cycle per unit quantity of cord).

The yarn product of the present improved process exhibits highly satisfactory Uster values which commonly range from about 0.5 to 0.9 percent, and preferably from about 0.6 to 0.7 percent. The Uster is a measure of the short term linear density or denier uniformity as is known in the art, and may be conventionally determined.

The product of the present process exhibits a highly satisfactory secant modulus value as exemplified in the Examples. As is known in the art the secant modulus is a recognized fundamental property of a fibrous product and is a measure of the overall fiber modulus from zero load to the breaking load. It is the average slope of the stress strain curve and is determined by dividing the tenacity in grams per denier by the elongation at break in fractional form.

It has been found that the fibrous product of the present process exhibits greatly improved fatigue resistance when compared to high strength and high modulus polyethylene terephthalate fibers conventionally utilized to form tire cords. This is a surprising characteristic to those skilled in the art since normally high modulus tire cords exhibit poorer fatigue resistance, thereby limiting their usefulness. Such fatigue resistance enables the fibrous reinforcement when embedded in rubber to better withstand bending, twisting, shearing, and conpressing. The superior fatigue resistance of the product of the present invention can be demonstrated through the use of (1) the Goodyear Mallory Fatigue Test (ASTM-D-885-59T), or (2) the Firestone-Shear-Compression-Extension Fatigue Test (SCEF). For instance, it has been found that when utilizing the Goodyear Mallory Fatigue test which combines compression with internal temperature generation, the product of the present invention runs about 2 to 10 times longer than the conventional polyester tire cord control at a given twist level, and the test tubes run about 50° C. cooler than the control. In the Firestone-Shear-Compression-Extension-Fatigue Test which simulates sidewall flexing, the product of the present invention also outperforms the conventional polyester tire cord at a given twist level.

Such superior fatigue resistance of the product is exhibited at a given tire cord twist level when compared with conventional commercially available tire cords. One accordingly now has the option of operating at a lower tire cord twist level thereby maximizing the strength and initial modulus of the resulting tire cords which are commonly adversely influenced if higher twist levels are required for the desired fatigue resistance. Also, the product of the present process forms tire cords which exhibit generally lower shrinkage characteristics than commerically available tire cords.

Tire cords formed from the product of the present process exhibit satisfactory LASE values (i.e. load at specified elongation values) when stretched 5% measured in pounds.

Also, the product of the present process when present in a tire cord performs well in standard peel tests, or the H adhesion test (i.e. ASTM-D-2138-62T).

When tires which incorporate reinforcing cords of the product of the present invention are analyzed by conventional Thermovision Analysis for heat generation under load, it is found that such tires run considerably cooler than tires which incorporate conventional commercially available tire cords.

The following Example Nos. 1, 2, 3, and 4 are given as specific illustrations of the improved process of the present invention with reference being made to FIG. 1 of the drawings. It should be understood, however, that the invention is not limited to the specific details set forth in the examples.

Standard commercial grade polyethylene terephthalate polymer suitable for tire yarn production having the intrinsic viscosity indicated hereafter was selected as the starting material. Such intrinsic viscosity was determined from a solution of 0.1 gram of polymer in 100 ml. of orthochlorophenol at 25° C. In each instance the polymer was substantially all polyethylene terephthalate and contained in excess of 99 mol percent polyethylene terephthalate units.

The polyethylene terephthalate polymer was advanced toward spinneret 1 after passing through conduit 4, a heater (not shown), pack 6, and a filter (not shown). The spinneret in each instance had a standard conical entrance and six concentric rings of holes. The filter was composed of fragmented metal or particulate sand in accordance with standard polymer filtration technology. The molten polyethylene terephthalate was at a temperature of approximately 300° C. when extruded through spinneret 1.

The resulting extruded polyethylene terephthalate 8 was passed directly from the holes of spinneret 1 through solidification or quench zone 10 which was formed with the aid of out flow quench stick 12 having a diameter of approximately 1.5 inches. The surface of the quench stick 12 was covered with a solid porous foam material so as to permit ready egress of the air quench medium which entered via conduit 14. While passing through solidification zone 10, the extruded polyethylene terephthalate was uniformly quenched and was transformed into two continuous lengths of as-spun polyethylene terephthalate yarn which subsequently were united into one continuous length below the exit end of the solidification zone. The polyethylene terephthalate was first transformed from a molten to a semi-solid consistency, and then from a semi-solid consistency to a solid consistency while passing through solidification zone 10.

After leaving the solidification zone 10 the filamentary material lightly contacted kiss rolls 16 and 18 which applied a yarn lubricant at an add-on level of 0.3 to 0.8 percent by weight, and next lightly contacted guide pins 20 and 22. The filamentary material was wrapped approximately five turns around driven godet roll 24 having a diameter of approximately 6 inches and separator roll 26 having a diameter of approximately 2 inches which was disposed in skewed relationship with respect to godet roll 24. Godet roll 24 and separator roll 26 were provided at ambient temperature (i.e. approximately 25° C.) and served as a stress isolation device.

From driven godet roll 24 the filamenatary material passed to a pair of driven skewed rolls 28 and 30 which rotated at a greater rate than driven godet roll 24 and separator roll 26. The filamentary material was wrapped around driven skewed rolls 28 and 30 in approximately five turns. Rolls 28 and 30 had a diameter of approximately 6 inches each and also were provided at ambient temperature (i.e. approximately 25° C.). No external heat was applied to the filamentary material as it continuously was passed from driven godet roll 24 to driven roll 30. A first draw zone 31 at ambient temperature (i.e. approximately 25° C.) was created at this intermediate area which accordingly was at a temperature below the glass transition temperature of the as-spun filamentary material.

The filamentary material next was subjected to a subsequent thermal treatment while under a longitudinal tension. More specifically, the filamentary material next was passed from driven roll 28 through a steam jet 32 which applied steam while at a temperature of 300° C. to the moving filamentary material from a double orifice. The steam jet 32 was located in a second draw zone. In excess of 90 percent of the maximum draw ratio of the as-spun filamentary material was achieved in the first and second draw zones. While present in the steam jet a longitudinal tension was exerted upon the filamentary material through the rotation of driven skewed rolls 34 and 36 having a diameter of approximately 7.6 inches and a greater surface speed than that of driven rolls 28 and 30. The filamentary material was wrapped around rolls 34 and 36 in approximately eight turns. Driven rolls 34 and 36 were provided in heated box 38 with the filamentary material entering and leaving the same through apertures in the walls. The air atmosphere within heated box 38 was selected at a temperature within the range from about 90° C. below the differential scanning calorimeter peak melting temperature of the filamentary material up to below the temperature at which filament coalescence occurs. While present in heated box 38 the filamentary material was heat set and underwent crystallization.

The resulting filamentary material next was passed from roll 36 to driven godet roll 40 and separator roll 42. Godet roll 40 and separator roll 42 were provided at ambient temperature (i.e. approximately 25° C.). These rolls were provided in a skewed relationship and the filamentary material was wrapped around the same in approximately eight turns. Godet roll 40 was driven at either the same or slightly lesser rate than rolls 34 and 36 indicated hereafter. The resulting product next was collected at winder 44 which rotated at the same rate as rolls 34 and 36. Further details concerning the examples are specified hereafter.

EXAMPLE 1

The spinneret 1 had 192 extrusion holes which measured 0.018 inch in diameter and 0.024 inch in length. The polyethylene terephthalate polymer had an intrinsic viscosity of 0.896 deciliters per gram, and a polymer throughput rate of 26 pounds per hour was utilized. The filter was composed of fragmented metal.

The quench stick 12 had a length of 36 inches. The upper end of quench stick 12 through which the air quench medium outwardly passed (i.e. the entrance end of the solidification zone) was situated 3 inches from the face of spinneret 1. The air supplied to quench stick 12 was provided at a temperaure of 50° C. and was supplied at a rate of 90 standard cubic feet per minute.

The relatively high stress exerted upon the filamentary material immediately below the exit end (i.e. lowest point of air outflow) of solidification zone 10 and prior to contact with kiss rolls 16 and 18 was approximately 0.1 gram per denier. The as-spun filamentary material was wrapped around driven godet roll 24 and separator roll 26 at a rate of 927 meters per minute, and at that point in the process exhibited a relatively high birefringence of $+22\times10^{-3}$. The maximum draw ratio for the as-spun filamentary material prior to being wrapped around driven godet roll 24 and separator roll 26 was approximately 2.9:1.

Driven rolls 28 and 30 were rotated at a rate of 1829 meters per minute and the filamentary material while present in ambient air was drawn on a stable basis at a draw ratio of 1.89:1 while present intermediate driven godet roll 24 and driven roll 30 in the substantial absence of filament neck drawing.

The superheated steam was applied to steam jet 32 at a pressure of 35 psi. Skewed rolls 34 and 36 had a surface speed of 2682 meters per minute. Skewed rolls 34 and 36 and the air atmosphere of heated box 38 were provided at a temperature of 220° C., and the filamentary material was drawn at a draw ratio of 1.46:1 while present in the area of steam jet 32.

Godet roll 40 and separator roll 42 were rotated at a surface speed of 2629 meters per minute, which resulted in a slight relaxation of the filamentary material at a ratio of 0.98:1, primarily at the point where the filamentary material left roll 36. Take-up winder 44 also was rotated at a surface speed of 2629 meters per minute. The total overall draw ratio was 2.76:1 prior to relaxation. The characteristics of the resulting yarn product are presented in Table A.

The yarn sample next was subjected to a further heat treatment designed to simulate the heat treatment commonly experienced by the yarn during the formation of a tire cord which incorporates the same. During conventional tire cord prduction the cord comprising 2 to 10 or more twisted yarn plies commonly is treated with adhesive from at least one aqueous bath and then is passed through a multizone oven (e.g. a Litzler Computreater oven) provided with heated air at successively elevated temperatures wherein the fibers initially are stretched and then are relaxed to slight degree. This conventional treatment is designed to improve adhesion to rubber and to physically stabilize the cord. During the present heat treatment the yarn sample was untwisted and the application of an adhesive from an aqueous system was omitted since this obviously would interfere with the subsequent analysis of the multifilament yarn structure. Accordingly, the untwisted yarn sample initially was passed through a plain water bath rather than through an aqueous adhesive bath, was heat treated as described, and then was analyzed. The yarn was passed through the Litzler Computreater oven provided with two heating zones at a rate of 20 yards per minute. A tension of 700 grams was applied in the first zone of the oven which was provided at 350° F. (i.e. 177° C.) and the yarn was maintained therein for 90 seconds durng which time a stretch of 1.3 percent was accompished. A tension of 350 grams was applied in the second zone of the oven which was provided at 450° F. (i.e. 232° C.) and the yarn was maintained therein for 50 seconds during which time a relaxation of 1.1 percent was accomplished. The characteristics of the resulting heat treated yarn product are presented in Table B.

Also presented in Table A are characteristics of a conventional commercially available tire cord yarn wherein relatively loss stress spinning conditions were utilized during its formation, and the resulting filaments were drawn to a substantial degree to develop tensile properties. Table B additionally includes the characteristics exhibited by such conventional commercially available tire cord yarn when treated in the Litzler Computreater oven substantially as described. More specifically, while present in the Litzler Computreater oven a tension of 1000 grams was applied in the first zone of the oven wherein a stretch of 1.6 percent was accomplished, and a tension of 400 grams was applied in the second zone of the oven wherein a relaxation of 2.4 percent was accomplished.

EXAMPLE 2

The spinneret 1 had 384 extrusion holes which measured 0.012 inch in diameter and 0.016 inch in length. The polyethylene terephthalate polymer had an intrinsic viscosity of 0.880 deciliters per gram, and a polymer throughput rate of 34 pounds per hour was utilized. The filter was composed of fragmented metal.

The quench stick 12 had a length of 36 inches. The upper end of quench stick 12 through which the air quench medium outwardly passed (i.e. the entrance end of the solidification zone) was situated 1 inch from the face of spinneret 1. The air supplied to quench stick 12 was provided at a temperature of 39° C. and was supplied at a rate of 60 standard cubic feet per minute.

The relatively high stress exerted upon the filamentary material immediately below the exit end (i.e. lowest point of air outflow) of solidification zone 10 and prior to contact with kiss rolls 16 and 18 was approximately 0.1 gram per denier. The as-spun filamentary material was wrapped around driven godet roll 24 and separator roll 26 at a surface speed of 1052 meters per minute, and at that point in the process exhibited a relatively high birefringence of $+25\times10^{-3}$. The maximum draw ratio for the as-spun filamentary material prior to being wrapped around driven godet roll 24 and separator roll 26 was approximately 2.7:1.

Driven rolls 28 and 30 were rotated at a surface speed of 1830 meters per minute and the filamentary material while present in ambient air was drawn on a stable basis at a draw ratio of 1.74:1 while present intermediate driven godet roll 24 and driven roll 30 in the substantial absence of filament neck drawing.

The superheated steam was applied to steam jet 32 at a pressure of 30 psi. Skewed rolls 34 and 36 had a surface speed of 2682 meters per minute. Skewed rolls 34 and 36 and the air atmosphere of heated box 38 were provided at a temperature of 190° C., and the filamentary material was drawn at a draw ratio of 1.46:1 while present in the area of steam jet 32.

Godet roll 40 and separator roll 42 were rotated at a rate of 2682 meters per minute. Take-up winder 44 also was rotated at a surface speed of 2682 meters per minute. The total overall draw ratio was 2.54:1. The characteristics of the resulting yarn product are presented in Table A.

Presented in Table B are the characteristics of the yarn product following further heat treatment in the Litzler Computreater oven substantially as described with respect to Example 1. More specifically, while present in the Litzler Computreater oven a tension of 850 grams was applied in the first zone of the oven wherein a stretch of 1.3 percent was accomplished, and a tension of 490 grams was applied in the second zone of the oven wherein a relaxation of 1.4 percent was accomplished.

EXAMPLE 3

The spinneret 1 had 480 extrusion holes which measured 0.014 inch in diameter and 0.037 inch in length. The polyethylene terephthalate polymer had an intrinsic viscosity of 0.88 deciliters per gram, and a polymer throughput rate of 37.3 pounds per hour was utilized. The filter was composed of sand.

The upper end of quench stick 12 through which the air quench medium outwardly passed (i.e. the entrance end of the solidification zone) was situated 1.25 inch from the face of spinneret 1. The air supplied to quench stick 12 was provided at a temperature of approximately 50° C. and was supplied at a rate of 70 standard cubic feet per minute.

The relatively high stress exerted upon the filamentary material immediately below the exit end (i.e. lowest point of air outflow) of solidification zone 10 and prior to contact with kiss rolls 16 and 18 was approximately 0.1 gram per denier. The as-spun filamentary material was wrapped around driven godet roll 24 and separator roll 26 at a surface speed of 996 meters per minute, and at that point in the process exhibited a relatively high birefringence of approximately $27\times10^{-3}$. The maximum draw ratio for the as-spun filamentary material prior to being wrapped around driven godet roll 24 and separator roll 26 was approximately 2.7:1.

Driven rolls 28 and 30 were rotated at a surface speed of 1727 meters per minute and the filamentary material while present in ambient air was drawn on a stable basis at a drawn ratio of 1.73:1 while present intermediate driven godet roll 24 and driven roll 30 in the substantial absence of filament neck drawing.

The superheated steam was applid to steam jet 32 at a pressure of 55 psi. Skewed rolls 34 and 36 had a surface speed of 2591 meters per minute. Skewed rolls 34 and 36 and the air atmosphere of heated box 38 were provided at a temperature of 170° C., and the filamentary material was drawn at a draw ratio of 1.50:1 while present in the area of steam jet 32.

Godet roll 40 and separator roll 42 were rotated at a surface speed of 2539 meters per minute, which resulted in a slight relaxation of the filamentary material at a ratio of 0.98:1, primarily at the point where the filamentary material left roll 36. Take-up winder 44 also was rotated at a rate of 2539 meters per minute. The total overall draw ratio was 2.60:1 prior to relaxation. The characteristics of the resulting yarn product are presented in Table A.

Presented in Table B are the characteristics of the yarn product following further heat treatment in the Litzler Computreater oven substantially as described with respect to Example 1. More specifically, while present in the Litzler Computreater oven a tension of 1000 grams was applied in the first zone of the oven wherein a stretch of 1.9 percent was accomplished, and a tension of 400 grams was applied in the second zone of the oven wherein a relaxation of 1.4 percent was accomplished.

EXAMPLE 4

Example 3 was repeated with the exception that the air atmosphere of heated box 38 was provided at a temperature of 220° C. instead of 170° C. The characteristics of the resulting yarn product are presented in Table A.

Presented in Table B are the characteristics of the yarn product following further heat treatment in the Litzler Computreater oven substantially as described with respect to Example 1. More specifically, while present in the Litzler Computreater oven a tension of 1000 grams was applied in the first zone of the oven wherein a stretch of 2.8 percent was accomplished, and a tension of 400 grams was applied in the second zone wherein a relaxation of 1.4 percent was accomplished.

TABLE A

| | Yarn Characteristics Prior to Treatment in Litzler Oven | | | | |
|---|---|---|---|---|---|
| | Conventional Commercially Available Tire Cord Yarn | Example 1 | Example 2 | Example 3 | Example 4 |
| Total Denier | 1001 | 665 | 850 | 1027 | 1022 |
| Average Denier Per Filament | 5.26 | 3.5 | 2.2 | 2.1 | 2.1 |
| Tenacity in Grams Per Denier Measured at 25° C. | 8.7 | 8.7 | 8.8 | 8.8 | 8.9 |
| Elongation in Percent Measured at 25° C. | 12 | 9.0 | 8.4 | 9.3 | 8.8 |
| Initial Modulus in Grams Per Denier Measured at 25° C. | 108 | 111 | 107 | 100 | 115 |
| Birefringence | +.1996 | +.1767 | +.1744 | +.1819 | +.1851 |
| Longitudinal Shrinkage Measured at 175° C. in Air in Percent | 8.8 | 6.0 | 9.0 | 7.2 | 4.0 |
| Work Loss at 150° C. | 0.060 | 0.013 | 0.032 | 0.025 | 0.027 |
| Crystallinity in Percent | 50.3 | 49.0 | 45.8 | 49.0 | 50.3 |
| Amorphous Orientation Function | 0.664 | 0.509 | 0.505 | 0.544 | 0.559 |
| Crystalline Orientation Function | 0.983 | 0.977 | 0.983 | 0.980 | 0.982 |
| Uster in Percent | 1.02 | 0.70 | 0.67 | 0.60 | 0.80 |
| Secant Modulus in Grams Per Denier | 72.5 | 96.7 | 104.8 | 94.6 | 101.1 |
| Stability Index | 1.9 | 12.8 | 3.5 | 5.6 | 9.3 |

TABLE A-continued

| | Yarn Characteristics Prior to Treatment in Litzler Oven | | | | |
|---|---|---|---|---|---|
| | Conventional Commercially Available Tire Cord Yarn | Example 1 | Example 2 | Example 3 | Example 4 |
| Tensile Index | 940 | 966 | 942 | 880 | 1023 |

TABLE B

| | Yarn Characteristics After Treatment in Litzler Oven | | | | |
|---|---|---|---|---|---|
| | Conventional Commercially Available Tire Cord Yarn | Example 1 | Example 2 | Example 3 | Example 4 |
| Tenacity in Grams Per Denier Measured at 25° C. | 8.6 | 8.5 | 8.1 | 8.7 | 8.8 |
| Elongation in Percent Measured at 25° C. | 11.1 | 8.2 | 8.0 | 9.1 | 9.3 |
| Initial Modulus in Grams Per Denier Measured at 25° C. | 124 | 122 | 120 | 123 | 110 |
| Birefringence | +.1929 | +.1839 | +.1782 | +.1867 | +.1827 |
| Longitudinal Shrinkage Measured at 175° C. in Air in Percent | 5.2 | 2.3 | 2.8 | 3.0 | 2.3 |
| Work Loss at 150° C. | 0.040 | 0.015 | 0.012 | 0.014 | 0.014 |
| Crystallinity in Percent | 54.8 | 54 | 55 | 55 | 56 |
| Amorphous Orientation Function | 0.601 | 0.533 | 0.486 | 0.555 | 0.523 |
| Crystalline Orientation Function | 0.980 | 0.980 | 0.976 | 0.973 | 0.971 |
| Secant Modulus in Grams Per Denier | 76.1 | 104 | 101 | 96 | 94 |
| Stability Index | 4.8 | 29.6 | 29.8 | 23.8 | 31 |
| Tensile Index | 1066 | 1037 | 972 | 1070 | 968 |

It will be noted in the Examples that the heat treatment of the conventional tire cord formation procedure heretofore described served to further beneficially modify the characteristics of the filaments and can be considered a portion of the heat treatment specified in the present process.

Although the invention has been described with preferred embodiments, it is to be understood that variations and modifications may be resorted to as will be apparent to those skilled in the art. Such variations and modifications are to be considered within the purview and scope of the claims appended hereto.

I claim:

1. In a process for the production of improved polyester filaments of high strength having an unusually stable internal structure which particularly are suited for use at elevated temperatures, comprising:

(a) extruding a molten melt-spinnable polyester which contains 85 to 100 mol percent polyethylene terephthalate and 0 to 15 mol percent of copolymerized ester units other than polyethylene terephthalate having an intrinsic viscosity of 0.5 to 2.0 deciliters per gram through a shaped extrusion orifice having a plurality of openings to form a molten filamentary material, (b) passing the resulting molten filamentary material in the direction of its length through a solidification zone having an entrance end and an exit end wherein said molten filamentary material is uniformly quenched and transformed into a solid filamentary material, (c) withdrawing said solid filamentary material from said solidification zone while under a substantial stress of 0.015 to 0.150 gram per denier measured immediately below the exit end of said solidification zone, (d) continuously conveying said resulting as-spun filamentary material from the exit end of said solidification zone to a stress isolation device at a rate in excess of 500 meters per minute up to 3000 meters per minute with said filamentary material as it enters said stress isolation device exhibiting a relatively high birefringence of $+9\times10^{-3}$ to $+70\times10^{-3}$, (e) continuously conveying said resulting filamentary material from said stress isolation device to a first draw zone, (f) continuously drawing said resulting filamentary material at a draw ratio of 1.01:1 to 3.0:1 while present in said first draw zone, and (g) subsequently thermally treating said previously drawn filamentary material while under a longitudinal tension and present at a temperature above that of said first draw zone to achieve at least 85 percent of the maximum draw ratio of said as-spun filamentary material and impart a tenacity of at least 7.5 grams per denier to the same, with at least the final portion of said thermal treatment being conducted at a temperature within the range from about 90° C. below the differential scanning calorimeter peak melting temperature of the same up to below the temperature of which filament coalescence occurs;

the improvement comprising providing said first draw zone in which step (f) is carried out, throughout at a temperature below the glass transition temperature of said as-spun filamentary material thereby facilitating a savings of energy when compared with polyethylene terephthalate drawing procedures of the prior art, and concomitantly enabling said drawing step (f) to be carried out in combination with the other process steps on a stable basis in the substantial absence of filament neck drawing.

2. An improved process according to claim 1 wherein said melt-spinnable polyester contains 90 to 100 mol percent polyethylene terephthalate.

3. An improved process according to claim 1 wherein said first draw zone is provided at a temperature of approximately 5° to 60° C.

4. An improved process according to claim 1 wherein said first draw zone is provided at a temperature of approximately 25° C.

5. An improved process according to claim 1 wherein a portion of step (g) is carried out concurrently with tire cord formation.

6. An improved process according to claim 1 wherein said solid filamentary material as it enters said first stress isolation device exhibits a birefringence of $+25\times10^{-3}$ to $+30\times10^{-3}$.

7. An improved process according to claim 1 wherein said thermal treatment of step (g) is carried out on a continuous in-line basis immediately following step (f).

8. An improved process according to claim 1 wherein said solid filamentary material as it enters said first stress isolation device exhibits a birefringence of $+20\times10^{-3}$ to $+35\times10^{-3}$.

9. An improved process according to claim 1 wherein said solid filamentary material enters said first stress isolation device at a rate in excess of 750 meters per minute.

10. An improved process according to claim 9 wherein solid filamentary material enters said first stress isolation device at a rate of between 750 and 1250 meters per minute.

11. An improved process according to claim 9 wherein said first draw zone is provided throughout at a temperature of approximately 5° to 60° C.

12. An improved process according to claim 11 wherein said first draw zone is provided throughout at a temperature of approximately 25° C.

13. An improved process according to claim 1 wherein the polyester filaments produced by the process exhibit a work loss of 0.004 to 0.02 inch-pounds when cycled between a stress of 0.6 gram per denier and 0.05 gram per denier at 150° C. measured at a constant strain rate of 0.5 inch per minute on a 10 inch length of yarn of said filaments normalized to that of a multifilament yarn of 1000 total denier.

14. An improved process according to claim 13 wherein a portion of step (g) is carried out concurrently with tire cord formation.

15. An improved process according to claim 17 wherein the polyester filaments produced by the process exhibit a work loss of 0.004 to 0.02 inch-pounds when cycled between a stress of 0.6 gram per denier and 0.05 gram per denier at 150° C. measured at a constant strain rate of 0.5 inch per minute on a 10 inch length of yarn of said filaments normalized to that of a multifilament yarn of 1000 total denier.

16. An improved process according to claim 15 wherein a portion of step (g) is carried out concurrently with tire cord formation.

17. An improved process for the production of polyester filaments of high strength which particularly are suited for use at elevated temperatures, comprising:

(a) extruding molten polyethylene terephthalate having an intrinsic viscosity of 0.85 to 0.94 deciliters per gram through a shaped extrusion orifice having a plurality of openings while at a temperature of about 280° to 320° C. to form a molten filamentary material, (b) passing the resulting molten polyethylene terephthalate material in the direction of its length through a solidification zone having an entrance end and an exit end provided with a gaseous atmosphere at a temperature of approximately 10° to 50° C. wherein said extruded polyethylene terephthalate material is uniformly quenched and transformed into a solid filamentary material;

(c) withdrawing said solid filamentary material from said solidification zone while under a substantial stress of 0.08 to 0.12 gram per denier measured immediately below the exit end of said solidification zone, (d) continuously conveying said resulting as-spun filamentary material from the exit end of said solidification zone to a stress isolation device at a rate of approximately 750 to 1250 meters per minute with said filamentary material as it enters said stress isolation device exhibiting a relatively high birefringence of $+25\times10^{-3}$ to $+30\times10^{-3}$, (e) continuously conveying said resulting filamentary material from said stress isolation device to a first draw zone which is provided throughout at a temperature of approximately 5° to 60° C., (f) continuously drawing said resulting filamentary material while present in said first draw zone at a draw ratio of about 1.4:1 to 2.0:1 on a stable basis in the substantial absence of filament neck drawing, and (g) subsequently thermally treating said previously drawn filamentary material while under a longitudinal tension and present at a temperature above that of said first draw zone to achieve at least 90 percent of the maximum draw ratio of said as-spun filamentary material and impart an average single filament tenacity of at least 7.5 grams per denier to the same, with at least the final portion of said thermal treatment being conducted at a temperature within the range of approximately 190° to 240° C.

18. An improved process according to claim 17 wherein said solidification zone is provided with a gaseous atmosphere at a temperature of approximately 10° to 50° C.

19. An improved process according to claim 17 wherein said resulting filamentary material is drawn at a draw ratio of approximately 1.7:1 to 1.9:1 while present in said first draw zone.

20. An improved process according to claim 17 wherein said thermal treatment step (g) is carried out on a continuous in-line basis immediately following step (f).

21. An improved process according to claim 17 wherein a portion of step (g) is carried out concurrently with tire cord formation.

* * * * *